United States Patent [19]

Ritchie

[11] 4,028,020

[45] June 7, 1977

[54] OIL SEAL FOR A ROTARY ENGINE

[75] Inventor: James A. Ritchie, Peoria, Ill.

[73] Assignee: Caterpillar Tractor Co., Peoria, Ill.

[22] Filed: Sept. 8, 1975

[21] Appl. No.: 611,038

[52] U.S. Cl. ..... 418/51; 418/142

[51] Int. Cl.[2] ..... F01C 19/08

[58] Field of Search ..... 418/49, 51, 52, 53, 418/142, 143, 140, 68; 73/258

[56] References Cited

UNITED STATES PATENTS

| | | | |
|---|---|---|---|
| 1,840,711 | 1/1932 | Goodner | 418/53 |
| 2,509,790 | 5/1950 | Stephenson | 418/49 X |
| 3,300,127 | 1/1967 | Yamamoto et al. | 418/142 X |
| 3,485,218 | 12/1969 | Clarke | 418/53 |

*Primary Examiner*—Carlton R. Croyle

*Assistant Examiner*—Leonard Smith

*Attorney, Agent, or Firm*—Wegner, Stellman, McCord, Wiles & Wood

[57] ABSTRACT

An improved slant axis rotary mechanism such as an engine, a compressor, a pump, or the like. The mechanism includes a housing, a shaft journalled in the housing having an angularly offset portion within the housing, and a rotor journalled within the housing on the angularly offset portion. The rotor hub has a pair of opposed grooves, each of which is adapted to receive a closed unitary annular seal which can be inserted therein to a predetermined depth. Additionally situated within each groove is a back-up spring urging the seal to bear against the housing and an O-ring providing a static seal between the seal and the groove.

3 Claims, 2 Drawing Figures

OIL SEAL FOR A ROTARY ENGINE

BACKGROUND OF THE INVENTION

This invention relates generally to a rotary mechanism, and more particularly, to a seal for a slant axis rotary mechanism used as an engine, a compressor, a pump, or the like.

In slant axis rotary mechanism, hub and peripheral seals are placed in grooves which are machined normal to the spherical surface in which they reside. Commonly, grooves for oil seals are oriented in a direction generally parallel to the direction of the hub seals. Consequently, the oil seals require the presence of undesirable gaps therein necessary to allow for expansion of the seal for installation on a rotor hub.

SUMMARY OF THE INVENTION

It is the principal object of the present invention to provide a new and improved slant axis rotary mechanism. More specifically, it is an object of the present invention to provide in such a mechanism a seal arrangement employing a simple closed unitary oil seal.

The exemplary embodiment of the present invention achieves the foregoing object in a mechanism including a housing defining an operating chamber and a shaft journalled in the housing having an angularly offset portion within the chamber. A rotor, having a bore for receiving the shaft, is journalled on the angularly offset portion for movement within the chamber. The rotor is provided with a seal receiving groove annularly disposed about the bore and a closed unitary oil seal bearing against the housing and residing within the groove. The size of the groove relative to the seal is such that the oil seal can be simply placed in the groove to the desired depth without expansion, thereby eliminating the need for a gap in the seal.

In a preferred embodiment, a circular back-up spring also resides within the groove to urge the seal to bear against the housing. The groove is machined slightly larger than the seal residing therein so that deflections of the housing or shaft during operation of the mechanism are accommodated. An O-ring residing within a groove formed in the seal provides a static seal and tends to prevent rotation of the seal during operation.

In a highly preferred embodiment, the sidewalls of the seal receiving groove have cylindrical configurations which are concentric with the shaft receiving bore of the rotor.

Other objects and advantages will become apparent from the following specification taken in conjunction with the accompanying drawings.

DESCRIPTION OF THE PREFERRED EMBODIMENT

Figure 1:
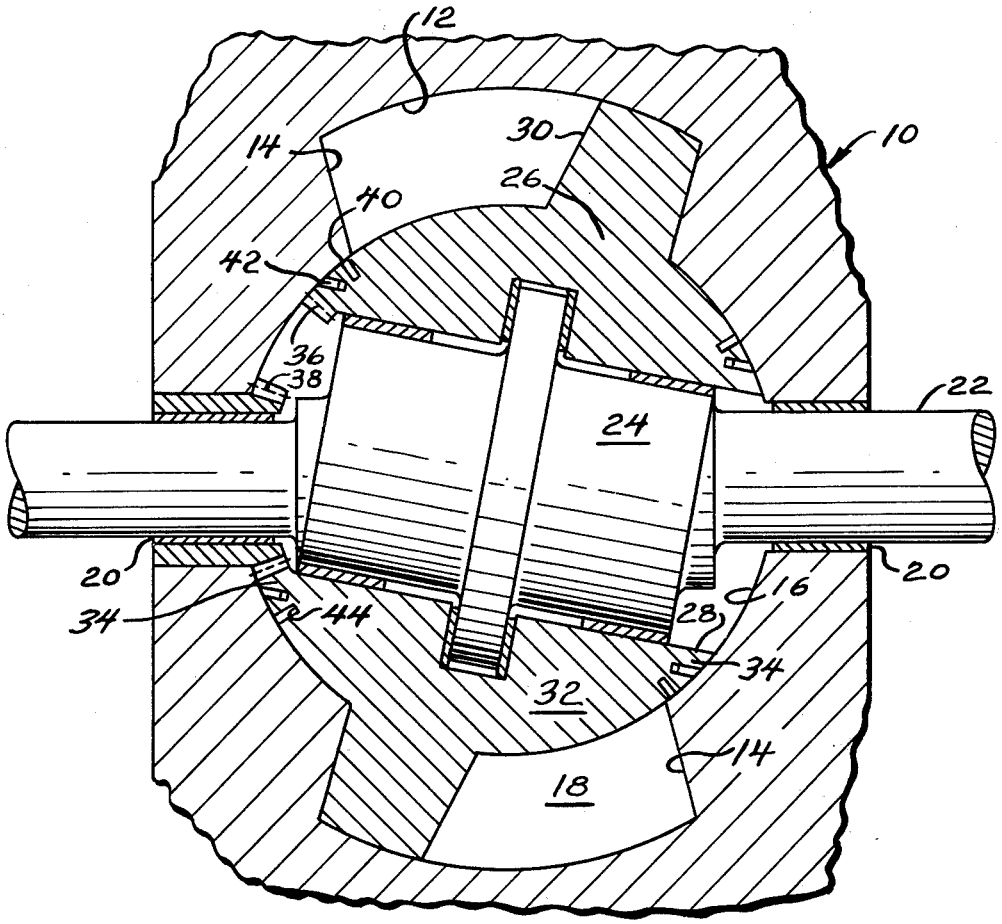
FIG. 1 is a sectional view of the slant axis rotary mechanism made according to the invention.

An exemplary embodiment of the slant axis rotary mechanism made according to the invention is illustrated in FIG. 1 in the form of an engine. It is understood, however, that the invention is susceptible to use in slant axis rotary mechanisms other than engines, such as compressors, pumps, or the like.

The slant axis rotary mechanism includes a housing, generally designated 10. Within the housing 10 there is an outer spherical peripheral wall 12, spaced, generally radially extending walls 14, and a radially inner, spherical peripheral wall 16. The walls 12, 14 and 16 define an operating chamber 18.

By means of bearings 20, the housing 10 journals a shaft 22 having an angularly offset portion 24 within the operating chamber 18. A rotor, generally designated 26, is journalled on the angularly offset portion 24 for movement within the operating chamber 18. The angularly offset portion 24 is received by a bore 28 extending through the rotor 26. Suitable bearings, not numbered, are disposed within the bore 28 between the angularly offset portion 24 and the rotor 26.

The rotor 26 includes a peripheral flange 30 which is provided with apex seals and peripheral seals (not shown). The rotor 26 also includes a spherical hub 32 having ends 34 through which the shaft 22 extends. The rotor 26 carries at one of the ends 34 an internal ring gear 36 which is in engagement with a fixed gear 38 carried by the housing 10 so that proper relative movement of the rotor 26 and the shaft 22 is attained.

The hub 32 carries near each end 34 a hub or gas seal 40 (compression seal) and a closed, unitary, ring shaped oil seal 42 both of which are annularly disposed about the bore 28 and surround the shaft 22. The hub seal 40 sealingly engages the radially inner peripheral wall 16 and resides in a groove 44 machined normal to the spherical surface of the hub 32. An oil seal 42 also engaging the radially inner wall 16 is provided because the hub seals 40 normally develop barrel shaped faces after prolonged use which tend to cause the hub seals 40 to ride over oil thereby allowing excess amounts of oil into combustion area producing high oil consumption and smoke.

Figure 2:
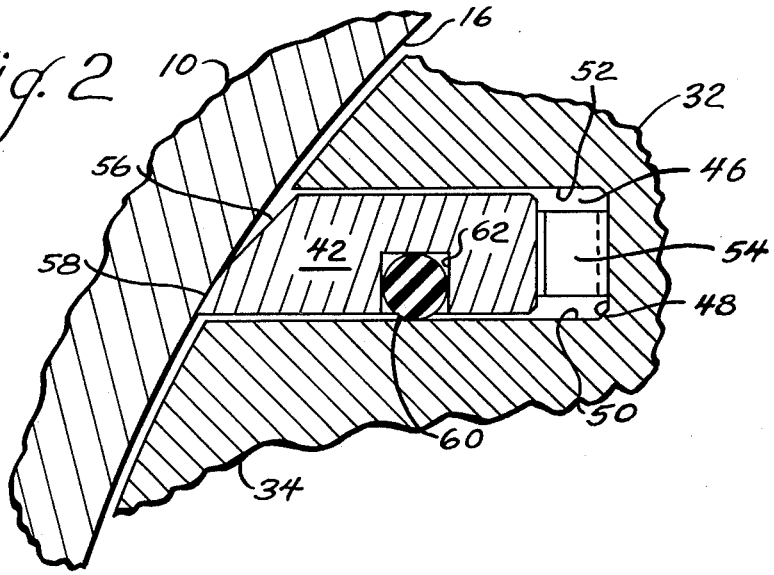
FIG. 2 is a fragmentary, enlarged view of a seal employed in the mechanism.

As best seen in FIG. 2, the seal 42 resides in a groove 46 defined by the hub 32 and bounded by a bottom 48, an inner cylindrical sidewall 50, and an outer cylindrical sidewall 52. The groove 46 is formed so that a closed unitary seal, such as seal 42, may reside therein between the sidewalls 50 and 52. The groove 46 is machined concentrically about the bore 28 so that the groove 46 is circular and so that the seal 42 can easily be inserted therein along the rotational axis of the rotor 26. The inside diameter of the seal 42 is made slightly larger than the inside diameter of the groove 46, while the outside diameter of the seal 42 is made slightly smaller than the outside diameter of the groove 46. Thus, the seal 42 resides loosely within the groove 46 so that deflections which occur during operation of the mechanism are accommodated.

A circular back-up spring 54 intermediate the seal 42 and the bottom 48 biases the seal 42 against the housing 10 along the wall 16. The seal 42 has a scraper face, generally designated 56. A land 58 coinciding with the spherical contour of the wall 16 is situated inwardly of the remainder of the face 56 and acts as a scraper edge which tends to scrape excess oil back to the crankcase. The land 58 may be lapped during use of the mechanism or prelapped during machining of the seal 42. The remainder of the face 56 is angularly disposed relative to the wall 16. An angle of 1 to 3 degrees is sufficient for most applications.

An elastic O-ring 60 resides in a groove 62 of the seal 42 to provide a static seal and permits the seal 42 to deflect during mechanism operation while maintaining a seal.

What is claimed is

1. In a slant axis rotary mechanism, the combination comprising:

a housing;

a rotor having spherical hub with an axial bore and within said housing;

a shaft journalled in said housing and having an angularly offset portion received in said bore and journalling said rotor;

said rotor hub having a pair of annular seal receiving grooves, said grooves being at opposite ends of said rotor hub and surrounding said bore, each of said grooves having a bottom, a radially inner sidewall and a radially outer sidewall, each of said grooves having a cross-sectional configuration such that the radius measured in a plane transverse to said axial bore of any interior portion of said inner sidewall is at least as great as the radius measured in a plane transverse to said axial bore of the rim of said inner sidewall; and a unitary closed ring seal residing within each of said grooves between said sidewalls for bearing against said housing.

2. The slant axis rotary mechanism of claim 1 wherein each of said inner sidewalls is cylindrical in configuration.

3. The slant axis rotary mechanism of claim 2 wherein each of said inner sidewalls is concentric with said bore.

* * * * *